US011168442B1

(12) United States Patent
Skawski

(10) Patent No.: US 11,168,442 B1
(45) Date of Patent: Nov. 9, 2021

(54) THROUGH-AIR APPARATUS WITH TENSION CAM MECHANISM

(71) Applicant: Valmet, Inc., Biddeford, ME (US)

(72) Inventor: Jan Skawski, Portland, ME (US)

(73) Assignee: Valmet, Inc., Biddeford, ME (US)

( * ) Notice: Subject to any disclaimer, the term of this patent is extended or adjusted under 35 U.S.C. 154(b) by 0 days.

(21) Appl. No.: 16/923,506

(22) Filed: Jul. 8, 2020

(51) Int. Cl.
*D21F 5/02* (2006.01)
*D21F 5/18* (2006.01)
*F26B 13/16* (2006.01)

(52) U.S. Cl.
CPC ..... *D21F 5/021* (2013.01); *D21F 5/182* (2013.01); *F26B 13/16* (2013.01)

(58) Field of Classification Search
CPC ..... F26B 13/16; F26B 13/18; D21F 5/182; D21F 5/184
See application file for complete search history.

(56) References Cited

U.S. PATENT DOCUMENTS 3,510,959 A * 5/1970 Fleissner ..... F26B 13/16 34/115
4,074,441 A 2/1978 Helversen et al.
4,625,376 A 12/1986 Schiel et al.
4,736,868 A 4/1988 Carmon, Jr.
5,556,514 A 9/1996 Didier
5,733,040 A 3/1998 Zuk et al.
6,032,383 A * 3/2000 Fleissner ..... D06B 23/025 34/115
6,044,575 A 4/2000 Marschke
6,079,116 A * 6/2000 Jewitt ..... D21F 5/182 34/115
6,258,267 B1 * 7/2001 Ota ..... B01D 35/16 210/238
6,904,700 B2 * 6/2005 Hada ..... D21F 5/182 34/114
6,918,195 B2 * 7/2005 Fleissner ..... D21F 5/182 34/620
7,040,038 B1 * 5/2006 Beaumont ..... D21F 5/182 162/204
7,060,163 B2 * 6/2006 Haider ..... D21F 5/182 162/375
7,249,472 B2 * 7/2007 Fleissner ..... D06B 23/025 68/5 C (Continued)

OTHER PUBLICATIONS

International Search Report with Written Opinion for corresponding International Patent Application No. PCT/US21/33825; dated Aug. 16, 2021; 14 pages.

*Primary Examiner* — Jason L Vaughan
(74) *Attorney, Agent, or Firm* — Pierce Atwood LLP; Kevin M. Farrell; Shannon Vittengl

(57) ABSTRACT

A through-air apparatus for drying or bonding paper or non-woven products is provided. The apparatus includes a through air roll, a first tension plate configured to hold a wire sleeve which is configured to extend around the roll, the first tension plate including at least one tension arc segment. The apparatus also includes a first cam mechanism associated with the at least one tension arc segment, wherein the first cam mechanism is configured to move the tension arc segment to adjust the position of the tension arc segment relative to the outer circumference of the first end of the roll, so that as the roll and first tension plate rotate about the first axis, the first tension plate is concentric with the roll.

20 Claims, 6 Drawing Sheets

(56) References Cited

U.S. PATENT DOCUMENTS

| | | | | |
|---|---|---|---|---|
| 7,690,131 | B2 * | 4/2010 | Mausser | D21F 5/021 34/124 |
| 9,045,304 | B2 * | 6/2015 | Li | B65H 20/12 |
| 9,428,861 | B2 * | 8/2016 | Consolato | F26B 13/18 |
| 10,914,035 | B1 * | 2/2021 | Seymour | D21F 5/182 |

* cited by examiner

PRIOR ART

THROUGH-AIR APPARATUS WITH TENSION CAM MECHANISM

FIELD OF THE INVENTION

The invention relates, in part, to a through-air apparatus for manufacturing products, and methods of use, which include a tension cam mechanism.

BACKGROUND

"Through air technology" is a term used to describe systems and methods enabling the flow of air through a paper or nonwoven web for the purpose of drying or bonding fibers or filaments. Examples include the drying of nonwoven products (e.g., tea bags and specialty papers); drying and curing of fiberglass mat, filter paper, and resin-treated nonwovens; thermobonding and drying of spunbond nonwovens; drying hydroentangled webs; thermobonding geotextiles with or without bicomponent fibers; drying and curing interlining grades; and thermobonding absorbent cores with fusible binder fibers. The drying of tissue paper is also another application of through air technology.

Systems and methods related to through-air drying are commonly referred to through the use of the "TAD" acronym. Systems and methods related to through-air bonding are commonly referred to through the use of the "TAB" acronym.

A through-air apparatus generally includes a fan/blower and a rigid air-permeable cylindrical shell (i.e. roll) configured to rotate about its central axis. The paper or non-woven web is partially wrapped around the cylindrical shell, and as the web travels around the rotating shell, air flows through the wall of the cylindrical shell to treat the web. The cylindrical shell wall typically has a plurality of openings to permit the passage of air.

SUMMARY OF THE INVENTION

In a first aspect, a method for matching tensioning ring diameter with a through-air roll diameter in a through-air dryer or bonding system is provided. The method includes a) providing a through-air roll with tensioning ring attachment lugs arrayed circumferentially about each end cap of the through-air roll, the tensioning attachment lugs being fitted with a rotating cam mechanism; and b) providing a plurality of tensioning ring segments each having a wire support surface and an assembly flange, which segments, when assembled, form a continuous tensioning ring with the assembly flange in direct or indirect contact with the cam mechanism on each tensioning ring attachment lug, whereby the radius of the continuous tensioning ring can be locally adjusted through rotation of one or more cam mechanism. The method further includes c) rotating one or more of the cam mechanism to adjust the tensioning ring segments so that the tensioning ring is concentric with the through-air roll.

In another aspect, a through-air apparatus for drying or bonding paper or non-woven products is provided. The apparatus includes a through air roll configured to rotate about a first axis, where the roll has a first end and a second end. The first end of the roll further includes a first tension plate configured to hold a wire sleeve which is configured to extend around the roll. The first tension plate includes at least one tension arc segment. The first end of the roll further includes a first cam mechanism associated with the at least one tension arc segment, where the first cam mechanism is configured to move the tension arc segment to adjust the position of the tension arc segment relative to the outer circumference of the first end of the roll, so that as the roll and first tension plate rotate about the first axis, the first tension plate is concentric with the roll.

In yet another aspect, a method of assembling a through-air apparatus for drying or bonding paper or non-woven products is provided. The method includes providing a through-air roll configured to rotate about a first axis, where the roll has a first end and a second end. The method also includes providing a wire sleeve around the roll, the wire sleeve having a first end and second end, and where the first end of the wire sleeve extends onto the first end of the roll, and securing the first end of the wire sleeve to the first end of the roll between a first tension plate and a first clamping plate, where the first tension plate includes at least one tension arc segment. The method further includes rotating a first cam mechanism associated with the at least one tension arc segment to move the tension arc segment to adjust the position of the tension arc segment relative to the outer circumference of the first end of the roll, so that as the roll and wire sleeve rotate about the first axis, the wire sleeve is concentric with the roll.

DETAILED DESCRIPTION

The present disclosure is directed to a through-air apparatus configured to manufacture paper or non-woven products. One of ordinary skill in the art would recognize that the through-air apparatus may be configured as a through-air dryer (TAD) and/or a through-air bonder (TAB), depending on the context in which the apparatus is used. One of ordinary skill in the art will also recognize that the through-air apparatus may be used to make paper or non-woven products that are rolled in their finished end product form. It should also be recognized that the product may not be rolled and/or may be cut into a finished end product. Furthermore, one of ordinary skill in the art will also recognize that the through-air apparatus may be configured to make paper or non-woven products, including, but not limited to various films, fabric, or web type material, and the apparatus may be used for various processes that may include mass transfer, heat transfer, material displacement, web handling, and quality monitoring, including, but not limited to drying, thermal bonding, sheet transfer, water extraction, web tensioning, and porosity measurement.

The web (i.e. product) is typically in a sheet-form and it is partially wrapped around a cylindrical shell (i.e. through-air roll). In one embodiment, the web is wrapped about a portion of the roll ranging from 5° to 360°, and typically between 180°-300° around the roll. The cylindrical wall of the through-air roll typically has a plurality of openings configured for air to pass through. The apparatus may include a fan/blower to circulate the air across the product, and the through-air roll is typically positioned within a hood to optimize the air flow characteristics. As the product travels around the rotating shell, the fan/blower circulates air through the wall of the cylindrical shell to treat the product. In certain embodiments, a heater may be provided to increase the temperature of the air that circulates through the through-air roll.

Figure 1:
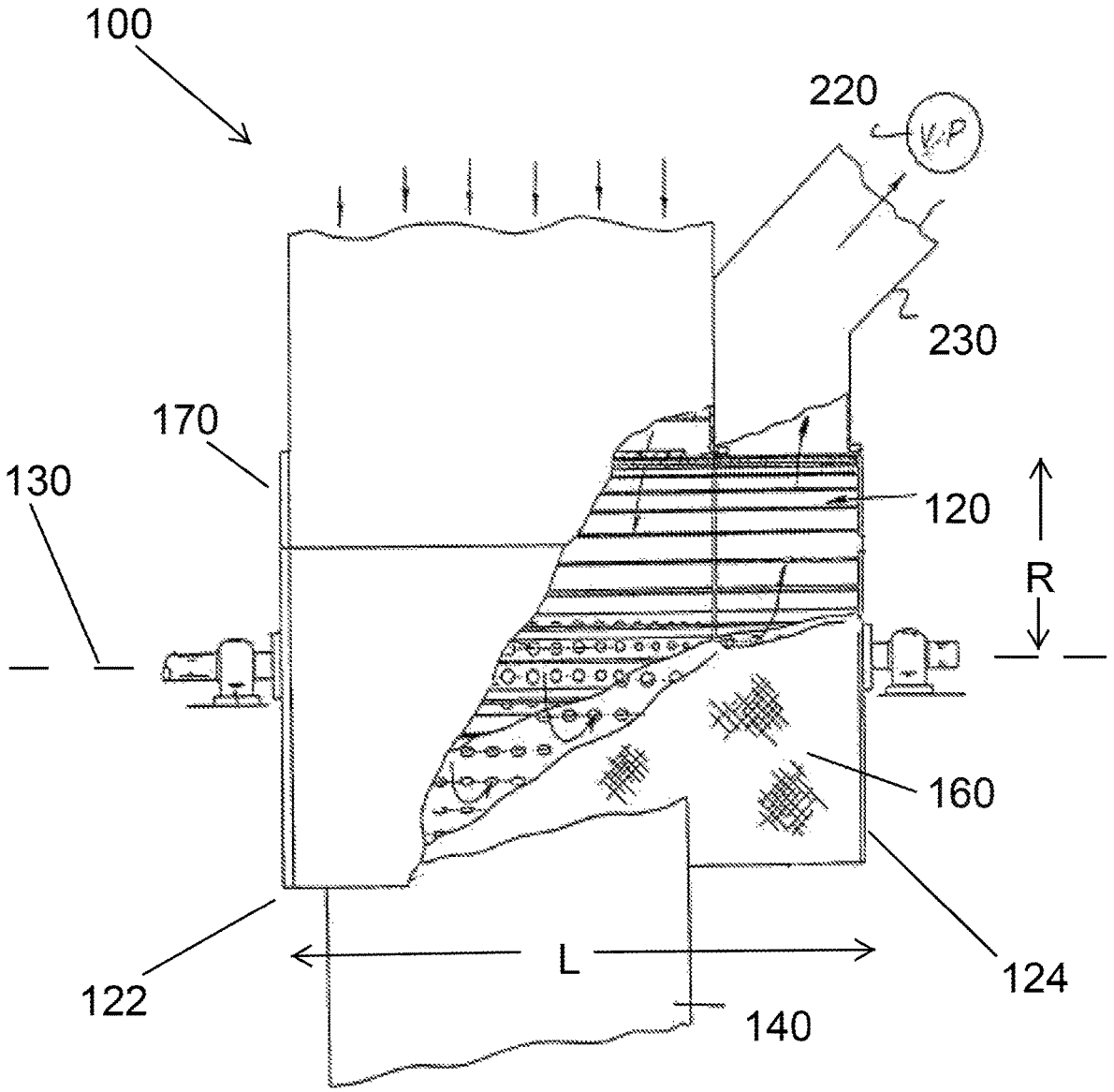
FIG. 1 is a side view of a through-air apparatus according to one embodiment.

One exemplary through-air apparatus 100 is illustrated in FIG. 1. As shown, the through-air apparatus 100 includes a though-air roll 120 that is configured to rotate about a first axis 130. The through-air roll 120 has a first end 122 and a second end 124. One end of the roll may be connected to a motor and drive assembly (i.e. drive side) and the opposite end may be known as the tend side, or the float end. A through-air apparatus 100 is typically a very large machine. For example, the through-air roll 120 may have a length L between 1 foot-30 feet, and a radius R between 1 foot -10 feet.

The cylindrical wall of the roll 120 may be formed of an open rigid structure to permit the flow of air therethrough. In one embodiment, the through-air roll 120 may be a HONEYCOMB ROLL® obtained from Valmet, Inc. As shown in FIG. 1, the apparatus may include an exhaust opening 230 and a vacuum source 220 so that air flows through the cylindrical wall of the roll 120 and out through the exhaust opening 230.

As shown in FIG. 1, the apparatus 100 may further include a sleeve 160 extending around the through-air roll 120 to provide support for the web 140 (i.e. product). The sleeve 160 may be made of a flexible material and it may be in sheet form. It is typically made of a wire mesh with openings smaller than the openings in the through-air roll 120. As shown in FIG. 1, the sleeve 160 may substantially cover the through-air roll 120. The wire sleeve 160 is secured to the through-air roll 120 and it is configured to rotate about the first axis 130 with the through-air roll 120. The sleeve may be made of various metal or plastic materials known to one of ordinary skill in the art.

The wire sleeve 160 may be installed on the roll 120 after the initial assembly of the through-air apparatus 100. Furthermore, the wire sleeve 160 may require replacement periodically during the life of the apparatus and/or may also be changed depending upon the particular product application. As set forth in more detail below, aspects of the present disclosure are directed to improved techniques for securing the wire sleeve 160 to the roll 120.

Figure 2:
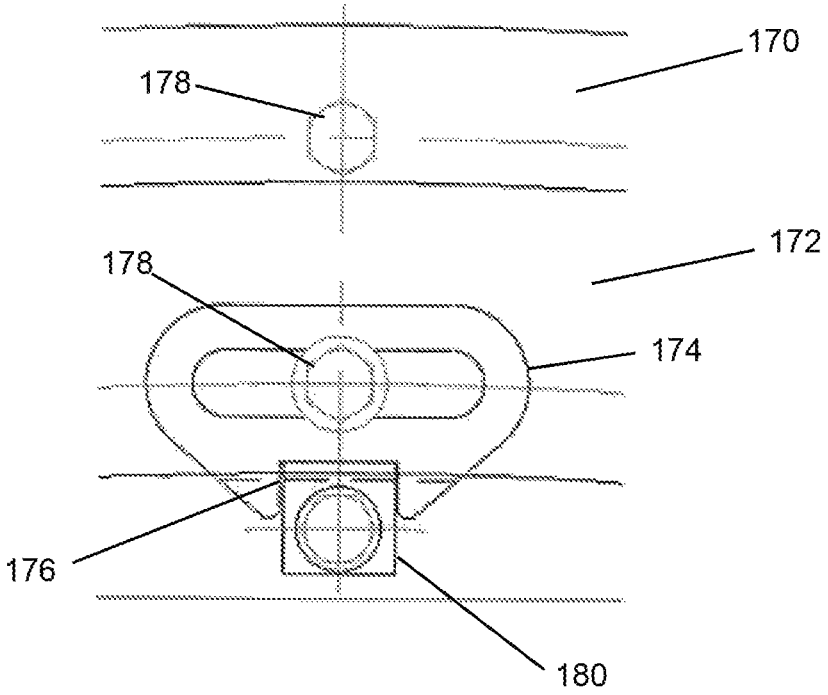
FIG. 2 is a detailed view of a prior art through-air apparatus.

Generally, the sleeve is fully wrapped around the roll 120 and is attached to the first and second ends 122 of the roll 120. The flexible wire sleeve 160 should be tensioned at each end to provide a smooth cylindrical surface to support the product. Typically, plates are provided on each end of the roll 120 to secure and tension the wire sleeve. As shown in FIG. 1, the through-air roll 120 may include a clamping plate 170 (also known as an end plate or clamping ring) positioned at both the first end 122 and the second end 124. The clamping plate 170 may be an annular shaped component coupled to each end of the cylindrical wall of the through-air roll 120. The wire sleeve 160 may extend past the cylindrical wall of the through-air roll 120 and around the clamping plate 170 on each end of the roll 120. As shown in FIG. 2 and as described in more detail below, a tension plate 172 may also be positioned on both ends 122, 124 of the roll. The wire sleeve 160 may be inserted between the clamping plate 170 and the tension plate 172. The tension plate 172 may be otherwise secured/tightened to retain each end of the wire sleeve 160 between the clamping plate 170 and the tension plate 172.

The clamping plate 170 and the tension plate 172 may be formed of at least one arc segment, or a plurality of arc segments which together each form an annular shape secured to each end of the through-air roll 120. A plurality of bolts/screws may be provided to tighten the tension plate 172 to the clamping plate 170 to secure the wire sleeve 160 between the plates.

FIG. 2 illustrates a close up end view of a prior art conventional approach to securing the wire sleeve (not shown) to each end of the roll 120. As mentioned above, the wire sleeve is retained between the clamping plate 170 and the tension plate 172 and bolts 178 may be tightened to secure the two plates 170, 172 together. An anti-rotational plate/bracket 174 is coupled to the tension plate 172 with a bolt/screw 178 extending through a slot in the bracket 174. As shown, a square lug 180 is positioned within a recess 176 in the bracket 174 and is used to secure the wire sleeve between the two plates 170, 172. One of ordinary skill in the art would recognize that the arrangement of the bracket 174 and square lug 180 (i.e. jack stop) nested within the bracket recess 176 is configured to limit rotation of the tension plate 172 about the axis 130. As shown, with the square lug 180 positioned within the square bracket recess 176, rotation of the lug 180 is prevented. These brackets 174 and square lugs 180 are spaced apart, for example about every 30°, around the generally circular perimeter of the tension plate 172 to secure the wire sleeve 160 to the first end 122 and the second end 124 of the roll 120.

The present disclosure is directed to improved ways of coupling the wire sleeve 160 to the through-air roll 120. In particular, the inventor recognized that in the conventional approach of securing the wire sleeve 160 to the through-air roll 120 shown in FIG. 2, there is no way to center and/or adjust the position of the tension plates 172. As discussed above, the roll 120 has a cylindrical wall having a substantially constant radius R (see FIG. 1). It is generally desirable to match the radius of the tension plates 172 to the radius of the roll. If there are one or more tension plates that have a different radius, problems may arise. A minor variation in radius may not be apparent when the apparatus is stationary. However, after installation of the wire sleeve 160 on the roll 120, variations in tension plate radius may cause the tension plate 172 and wire sleeve 160 to have an oblong or egg-shape when rotating about the axis 130. This may be undesirable for several reasons. First, this non-uniform shape may look problematic to the end-user. Second, this non-uniform shape of the wire sleeve and tension plate may cause uneven wear on certain portions of the wire sleeve. This may result in more frequent replacements of the wire sleeve which leads to more downtime and added costs.

As set forth in more detail below, aspects of the present disclosure are directed to improvements in coupling the wire sleeve 160 to the roll 120, so that the tension plates 172 and wire sleeve 160 have a more uniform circular shape when rotating about the axis 130, to match the constant radius of the roll 120. This may be desirable as it may help distribute the stresses in the wire sleeve 160 more uniformly about the entire sleeve. This may extend the longevity of the wire sleeve which leads to less frequent replacements of the wire sleeve, less downtime and cost savings.

As set forth below, aspects of the present disclosure are directed to a tension cam mechanism that can be used to adjust one or more tension ring segments 372 so that the tension ring is concentric with the through-air roll 120. As set forth below, rotation of the cam mechanism can adjust the position of the tension ring segment to alter the radius. As set forth below, the disclosure contemplated embodiments where the cam mechanism is in direct contact with a tension ring segment. As set forth below, the disclosure also contemplates embodiments where the cam mechanism is in indirect contact with a tension ring segment. As also set forth below, the disclosure contemplates embodiments where there is a single tension arc segment and the tension cam mechanism may be used to align the center of the single tension arc segment (that forms the tension plate) with the center of the through-air roll. Furthermore, the disclosure contemplates embodiments where there is at least one tension arc segment, and also embodiments where there are a plurality of tension arc segments that form the tension plate, as the disclosure is not so limited.

Figure 3:
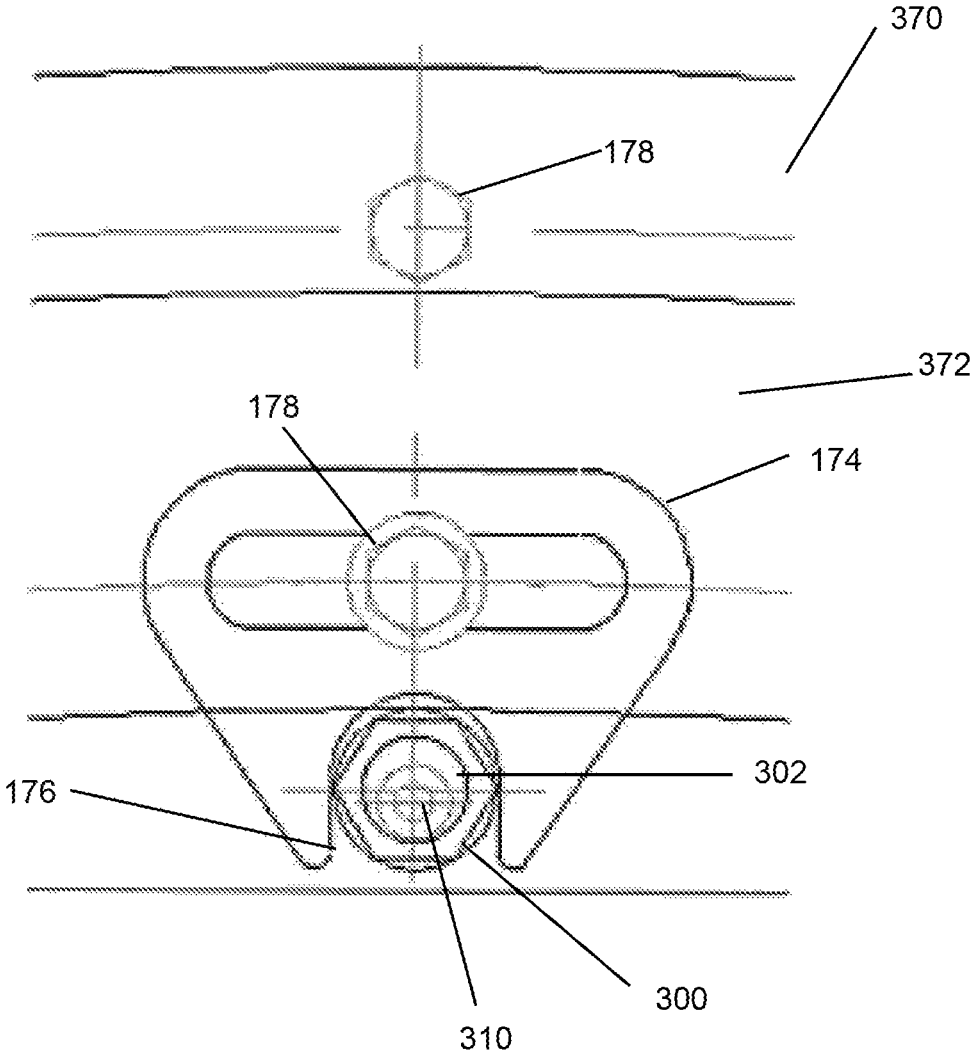
FIG. 3 is a detailed view of a tension cam mechanism on a through-air apparatus according to one embodiment.
Figure 5:
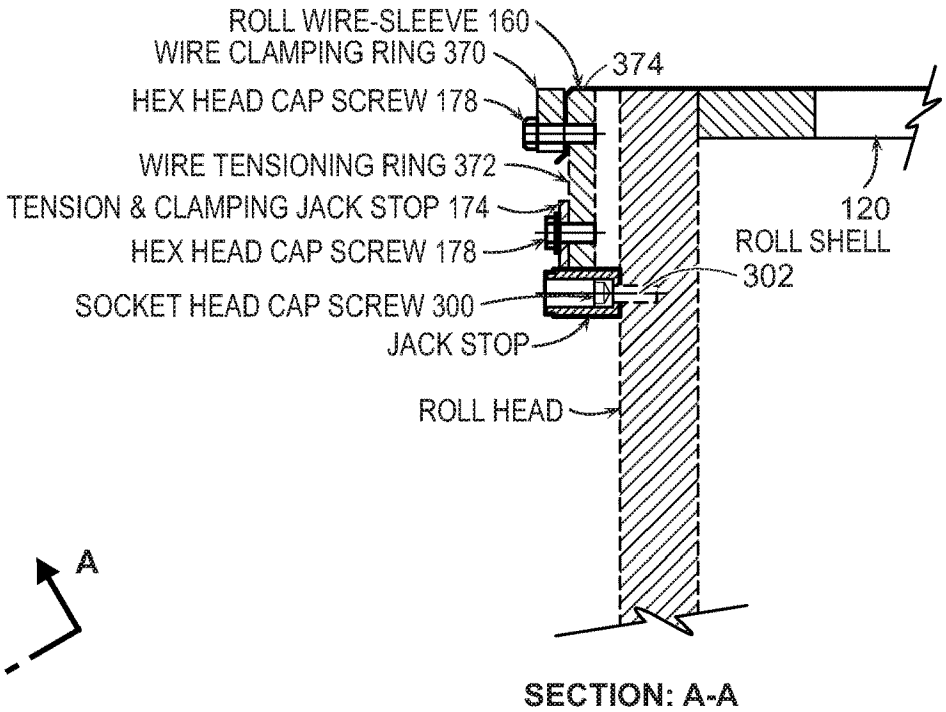
FIG. 5 is a cross-sectional view of the tension cam mechanism taken along line A-A shown in FIG. 4.
Figure 4:
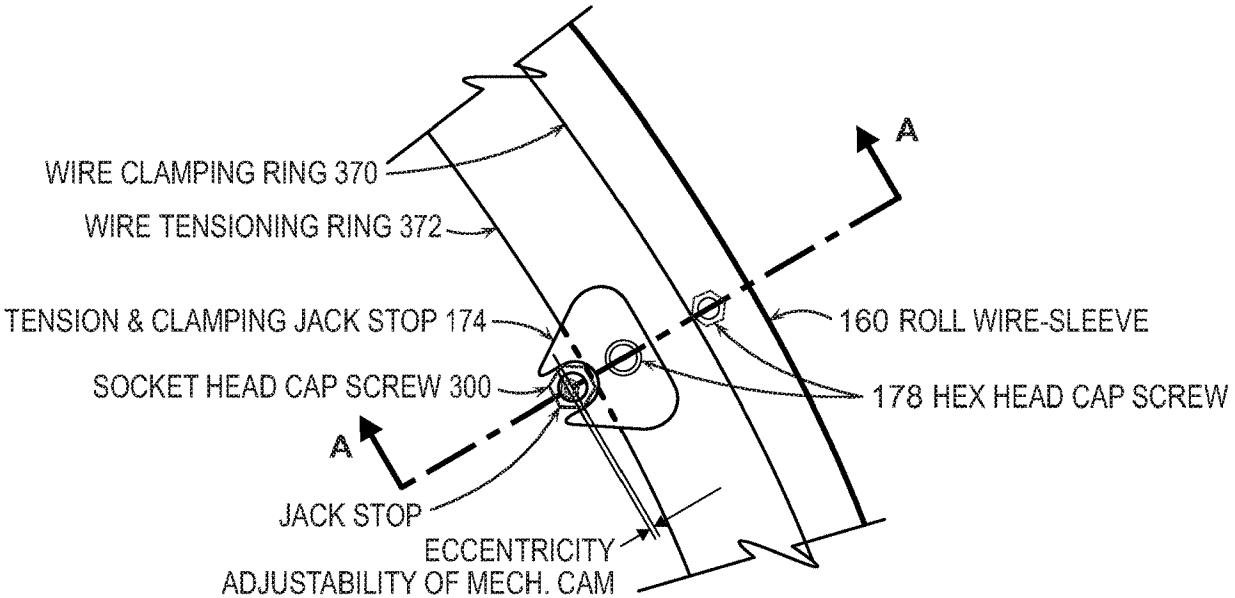
FIG. 4 is another view of the tension cam mechanism shown in FIG. 3.

One embodiment of a new through-air apparatus is shown in FIGS. 3-5. Like FIG. 2, FIG. 3 is a close up end view of a portion of one end 122, 124, of the through-air roll 120. Similar to the above-described configuration shown in FIG. 2, this embodiment includes a tension plate (formed of at least one tension arc segment 372, also known as tensioning ring segments) used to retain the wire sleeve 160 to each end 122, 124 of the roll 120. The roll may include a clamping plate, and the tension plate may be secured to the clamping plate, to secure the wire sleeve 160 between. As stated above, the tension plate and the clamping plate may be formed of one or more segments which together each form an annular shape secured to each end of the through-air roll 120. A plurality of bolts/screws may be provided to tighten the tension plate to the clamping plate to secure the wire sleeve 160. A first tension arc segment 372 (i.e. tensioning ring segment) and a first clamping plate arc segment 370 are illustrated in FIGS. 3-5.

As shown in FIGS. 3-5, the apparatus includes an attachment lug 302 with a cam mechanism 300 associated with the first tension arc segment 372. The cam mechanism 300 is configured to move the first tension arc segment 372 to adjust the position of the first tension arc segment 372 relative to the outer circumference of the first end of the roll 120, so that as the roll 120 and first tension plate rotate about the first axis 130, the first tension plate is concentric with the roll. In one illustrative embodiment, the cam mechanism 300 is rotatably attached to the attachment lug 302. Each tension arc segment 372 may have a wire sleeve support surface 374 and an attachment flange, where the attachment flange is either in direct or indirect contact with the cam mechanism 300 on each attachment lug 302.

As shown, the cam mechanism 300 is configured so that rotation of the cam mechanism 300 modifies the position of the first tension arc segment 372. As set forth in more detail below, in one embodiment, there is direct contact between the cam mechanism 300 and the tension arc segment 372. In another embodiment described below, there is indirect contact between the cam mechanism 300 and the tension arc segment 372. In both configurations, movement of the cam mechanism can adjust the radial position of the tension arc segment 372. This ability to independently adjust each tension arc segment 372 can minimize, and even eliminate the above mentioned problems associated with the prior art approach shown in FIG. 2. It should be appreciated that although FIG. 3 only illustrates one attachment lug 302 with cam mechanism 300 and one tension arc segment 372, the present disclosure contemplates a configuration with a plurality of cam mechanisms 300 and a plurality of tension arc segments 372 spaced apart around the first axis 130 of the roll. Furthermore, the disclosure also contemplates a configuration with a single tension arc segment. One of ordinary skill in the art will recognize that a single tension arc segment may be substantially annular shaped.

As shown in FIG. 3, in one embodiment, the cam mechanism 300 is eccentric, such that its axis of rotation 310 is not centrally located on the cam mechanism 300. Accordingly, the distance between the cam axis of rotation 310 and an outer surface of the cam mechanism is not uniform about its periphery. In one embodiment, one of the outer surfaces of the cam mechanism makes direct contact with a surface of the tension arc segment 372. Thus, as the cam mechanism 300 is rotated about the cam axis of rotation 310, the cam mechanism 300 can initiate movement of the tension arc segment 372.

As shown in FIGS. 3-5, the apparatus may include an anti-rotational plate/bracket 174 coupled to tension arc segment 372 with a bolt/screw 178 extending through a slot in the bracket 174. As discussed above with respect to FIG. 2, the bracket/plate 174 has a recess 176. The cam mechanism 300 may be positioned within the recess 176 of the bracket 174 and the anti-rotation plate 174 is configured to limit rotation of the tension arc segment 372 about the axis 130. In this illustrative embodiment, the cam mechanism 300 is in indirect contact with the tension arc segment 372 (i.e. tensioning ring segment). The cam mechanism 300 is configured to directly contact the anti-rotational plate 174 (which is coupled to the tension arc segment) such that rotation of the cam mechanism 300 imparts movement of the tension arc segment 372.

As shown in FIG. 3, the cam mechanism 300 is positioned within the recess 176 so that as the cam mechanism 300 rotates about its cam axis of rotation 310, an outer edge of the cam mechanism contacts a surface of the recess 176 which imparts movement of the tension arc segment 372. One of ordinary skill in the art will appreciate that as the cam mechanism 300 rotates, the distance between the axis of rotation 310 and the outer edge of the cam mechanism that contacts a surface of the recess 176 changes, thus adjusting the position of the tension arc segment 372 so that the radius of the tension ring can be matched to the radius of the through-air roll 120.

FIGS. 3-5 illustrate a first attachment lug 302 with a first cam mechanism 300 and its associated first tension arc segment 372. A second lug and a second cam mechanism and its associated second tension arc segment may also be provided to adjust the position of the second tension arc segment relative to the outer circumference of the first end of the roller, so that as the roller and the first tension plate rotate about the first axis, the first tension plate is concentric with the roller. It should be appreciated that the second tension arc segment may be adjacent the first tension arc segment. It should be appreciated that a plurality of lugs and cam mechanisms and a plurality of tension arc segments may be spaced apart around each end 122, 124 of the roll 120 to couple the wire sleeve 160 to the roll. The plurality of tension arc segments (i.e. first tension plate) may together form an outer circumference of the wire sleeve 160 which can be adjusted to approximate the outer circumference of the roll 120.

Furthermore, in one embodiment, the second opposite end 124 of the roll further includes a second tension plate configured to hold a wire sleeve. The second tension plate may be substantially similar to the first tension plate on the first end 122 of the roll, and the second tension plate may include at least one tension arc segment, or a plurality of tension arc segments which together approximate the outer circumference of the second end of the roll. The plurality of tension arc segments may include a third tension arc segment, and a third cam mechanism is associated with the third tension arc segment, where the third cam mechanism is configured to move the third tension arc segment to adjust the position of the third tension arc segment relative to the outer circumference of the second end of the roll, so that as the roll and second tension plate rotate about the first axis, the second tension plate is concentric with the roll.

Figure 6:
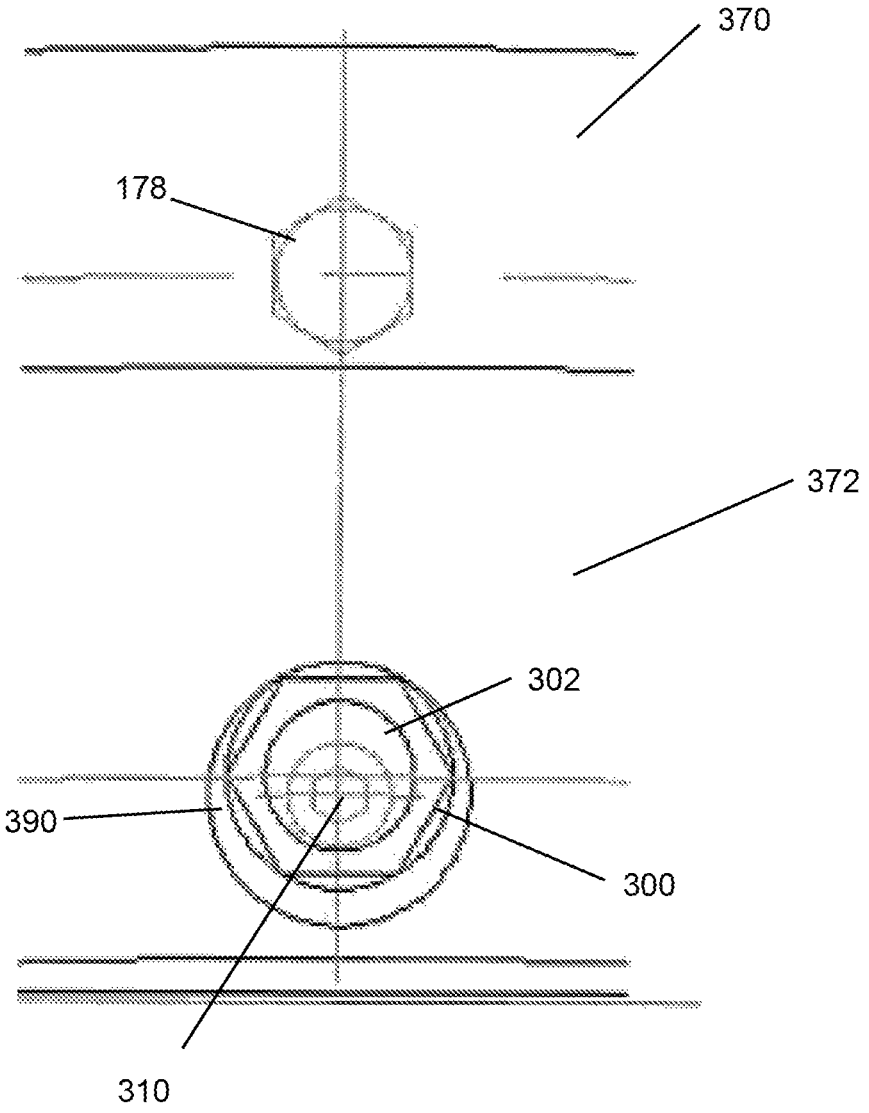
FIG. 6 is a detailed view of a tension cam mechanism on a through-air apparatus according to another embodiment.
Figure 8:
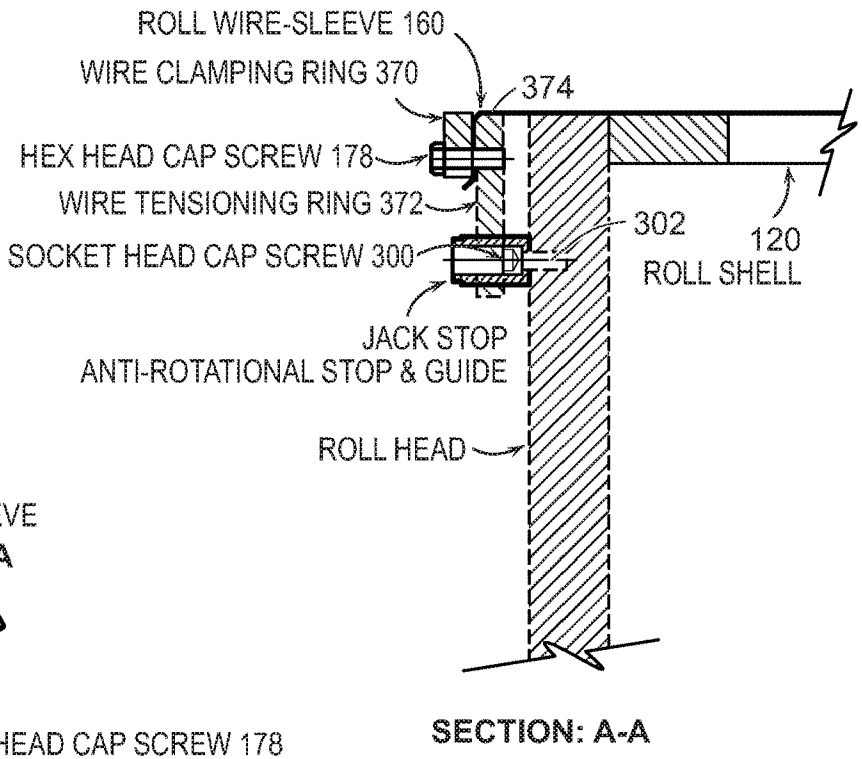
FIG. 8 is a cross-sectional view of the tension cam mechanism taken along line A-A shown in FIG. 7.
Figure 7:
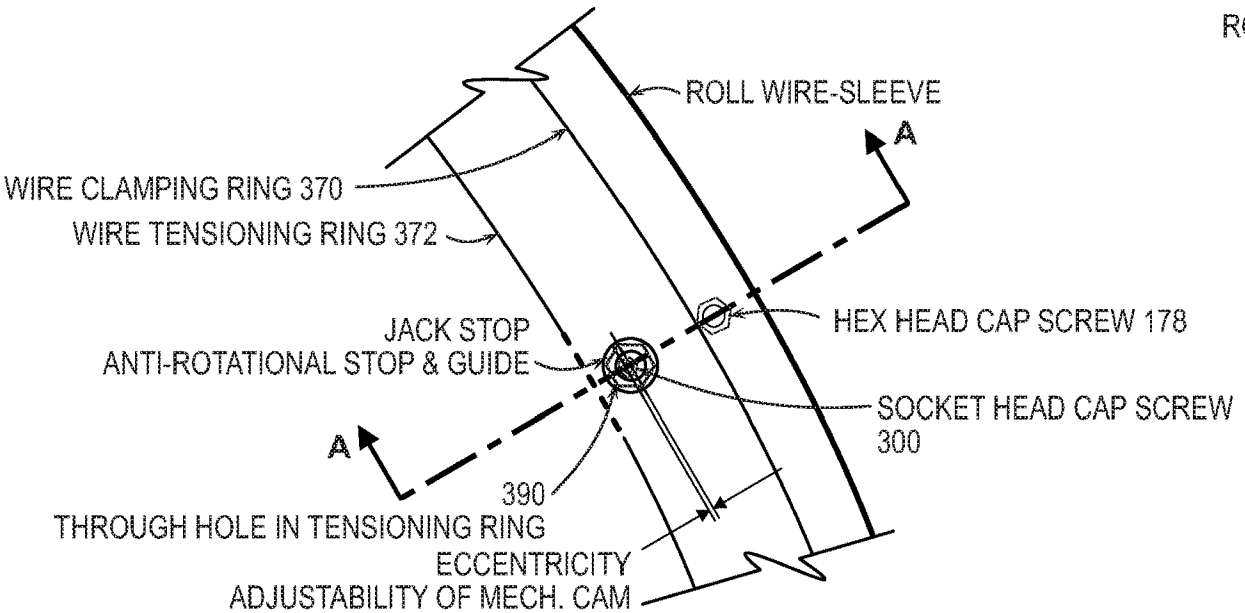
FIG. 7 is another view of the tension cam mechanism shown in FIG. 6.

Turning now to FIGS. 6-8, another embodiment is illustrated which also includes an attachment lug 302 with a cam mechanism 300 configured to adjust a tension arc segment 372. Some of the components in this embodiment are substantially identical to the above-described embodiment shown in FIGS. 3-5 and described above. However, instead of having indirect contact through the anti-rotational plate 174, in the embodiment shown in FIGS. 6-8, there is direct contact between the cam mechanism 300 and the tension arc segment 372. In particular, tension arc segment 372 includes an opening/bore 390 therethrough, and the cam mechanism 300 is positioned within the opening 390. As shown in FIG. 6, the bore 390 has a radius fractionally larger than the sweep radius of the rotating cam mechanism 300. As discussed above, the cam mechanism is eccentric, such that its cam axis of rotation 310 is not centrally located on the cam mechanism 300. Accordingly, the distance between the cam axis 310 and an outer surface of the cam mechanism is not uniform. As the cam mechanism 300 is rotated about the cam axis 310, the cam mechanism 300 contacts a surface of the bore 390 which directly initiates movement of the tension arc segment 372. In this embodiment, the inside surface of the bore 390 is the attachment flange of the tension ring segment.

The embodiment shown in FIGS. 6-8 does not include the anti-rotational plate/bracket 174 shown in FIGS. 3-5. However, it should be appreciated that in the embodiment shown in FIGS. 6-8, with the cam mechanism 300 positioned in the bore 390, the size and shape of the bore 390 in the tension arc segment 372 is configured to limit rotation of the tension arc segment 372 about the axis 130 without requiring a separate bracket.

In one embodiment, an end of the cam mechanism 300 is hexagon shaped. Cam mechanisms having ends of other shapes are also contemplated, as the disclosure is not so limited. An infinite number of different shaped cam mechanisms, when rotated, would enable one to adjust the position of the tension arc segments so that the tension plate is concentric with the roll 120.

Aspects of the present disclosure are directed to methods of matching the tensioning ring diameter with a through-air roll diameter in a through-air dryer or bonding system. The method includes providing a through-air roll 120 with tensioning ring attachment lugs 302 arrayed circumferentially about each end cap of the through-air roll 120, the tensioning attachment lugs 302 being fitted with a rotating cam mechanism 300. The method also includes providing a plurality of tensioning ring segments 372 each having a wire support surface 374 and an assembly flange, which segments, when assembled, form a continuous tensioning ring with the assembly flange in direct or indirect contact with the cam mechanism 300 on each tensioning ring attachment lug, whereby the radius of the continuous tensioning ring can be locally adjusted through rotation of one or more cam mechanism 300. The method further includes rotating one or more of the cam mechanism 300 to adjust the tensioning ring segments 372 so that the tensioning ring is concentric with the through-air roll 120.

In one embodiment, the cam mechanism 300 rotatably attached to each tensioning ring attachment lug 302 is in direct contact with a tensioning ring segment. Furthermore, the assembly flange of each tensioning ring segment may include one or more bores 390 having a radius fractionally larger than the swept radius of the rotating cam mechanism 300. During the assembly of the plurality of tensioning ring segments 372, a tension ring attachment lug 302 with rotating cam mechanism 300 is inserted into a bore 390 in a tension ring segment 372 and, following assembly of all tension ring segments 372 to form the continuous tensioning ring, individual cam mechanisms 300 are rotated causing local continuous tensioning ring radius changes thereby enabling radius matching between the continuous tensioning ring and the through-air roll 120.

In another embodiment, the cam mechanism 300 rotatably attached to each tensioning ring attachment lug 302 is in indirect contact with a tensioning ring segment through, for example, an intermediate anti-rotation plate 174.

Aspects of the present disclosure are also directed to a method of assembling a through-air apparatus 100 for drying or bonding paper or non-woven products. The method includes providing a through-air roll 120 configured to rotate about a first axis 130, where the roll has a first end 122, and a second end 124, and providing a wire sleeve 160 around the roll. The wire sleeve having a first end and second end, and where the first end of the wire sleeve extends onto the first end of the roll. The method further includes securing the first end of the wire sleeve to the first end of the roll between a first tension plate and a first clamping plate. The first tension plate includes at least one tension arc segment 372. The method also includes rotating a first cam mechanism 300 associated with the at least one tension arc segment to move the tension arc segment 372 to adjust the position of the tension arc segment relative to the outer circumference of the first end of the roll, so that as the roll and wire sleeve 160 rotate about the first axis 130, the wire sleeve is concentric with the roll.

Although several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto; the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A through-air apparatus for drying or bonding paper or non-woven products, the apparatus comprising:

a through air roll configured to rotate about a first axis, wherein the roll has a first end and a second end;

the first end of the roll further comprising:

a first tension plate configured to hold a wire sleeve which is configured to extend around the roll, the first tension plate comprising at least one tension arc segment; and a first cam mechanism associated with the at least one tension arc segment, wherein the first cam mechanism is configured to move the at least one tension arc segment to adjust the position of the at least one tension arc segment relative to the outer circumference of the first end of the roll, so that as the roll and first tension plate rotate about the first axis, the first tension plate is concentric with the roll.

2. The through-air apparatus of claim 1, further comprising:

a wire sleeve extending around the roll, the wire sleeve having a first end and second end, and wherein the first end of the wire sleeve extends onto the first end of the roll and is retained by the first tension plate, such that an outer circumference of the first tension plate forms an outer circumference of the wire sleeve.

3. The through-air apparatus of claim 1, the first end of the roll further comprising:

a first clamping plate configured to hold a wire sleeve around the roll, wherein the first clamping plate is positioned adjacent the first tension plate such that a wire sleeve can be retained between the first tension plate and the first clamping plate.

4. The through-air apparatus of claim 1, wherein the apparatus is configured as a through air dryer (TAD).

5. The through-air apparatus of claim 1, wherein the apparatus is configured as a through air bonder (TAB).

6. The through-air apparatus of claim 1, further comprising an anti-rotational plate associated with the at least one tension arc segment, wherein the anti-rotational plate is configured to limit rotation of the at least one tension arc segment about the first axis.

7. The through-air apparatus of claim 6, wherein the anti-rotational plate includes a recess, and wherein the first cam mechanism is configured to be received within the recess.

8. The through-air apparatus of claim 1, wherein the first cam mechanism is rotatable about a first cam mechanism axis, and wherein the cam mechanism is eccentric such that the first cam mechanism axis is not centrally located on the first cam mechanism.

9. The through-air apparatus of claim 8, wherein an end of the first cam mechanism is hexagon shaped.

10. The through-air apparatus of claim 1, wherein the at least one tension arc segment includes a bore therethrough, wherein the first cam mechanism is configured to be received within the bore.

11. The through-air apparatus of claim 1, wherein the first tension plate includes a single tension arc segment.

12. The through-air apparatus of claim 11, wherein the second tension arc segment is adjacent to the first tension arc segment.

13. The through-air apparatus of claim 11, the second end of the roll further comprising: a second tension plate configured to hold a wire sleeve which is configured to extend around the roll, the second tension plate comprising a plurality of tension arc segments which together approximate the outer circumference of the roll, and wherein the plurality of tension arc segments include a third tension arc segment; and a third cam mechanism associated with the third tension arc segment, wherein the third cam mechanism is configured to move the third tension arc segment to adjust the position of the third tension arc segment relative to the outer circumference of the second end of the roll, so that as the roll and second tension plate rotate about the first axis, the second tension plate is concentric with the roll.

14. The through-air apparatus of claim 11, wherein the single tension arc segment is substantially annular shaped.

15. The through-air apparatus of claim 1, wherein the first tension plate comprises a plurality of tension arc segments, including a first tension arc segment and a second tension arc segment, wherein the at least one tension arc segment is the first tension arc segment.

16. The through-air apparatus of claim 15, further comprising:

a second cam mechanism associated with the second tension arc segment, wherein the second cam mechanism is configured to move the second tension arc segment to adjust the position of the second tension arc segment relative to the outer circumference of the first end of the roll, so that as the roll and first tension plate rotate about the first axis, the first tension plate is concentric with the roll.

17. The through-air apparatus of claim 15, further comprising a plurality of cam mechanisms associated with the plurality of tension arc segments, wherein the plurality of cam mechanisms are configured to move the plurality of tension arc segments to adjust the position of the plurality of tension arc segments relative to the outer circumference of the roll.

18. The through-air apparatus of claim 15, wherein the plurality of tension arc segments are together substantially annular shaped.

19. A method of assembling a through-air apparatus for drying or bonding paper or non-woven products, the method comprising:

providing a through-air roll configured to rotate about a first axis, wherein the roll has a first end and a second end;

providing a wire sleeve around the roll, the wire sleeve having a first end and second end, and wherein the first end of the wire sleeve extends onto the first end of the roll;

securing the first end of the wire sleeve to the first end of the roll between a first tension plate and a first clamping plate, wherein the first tension plate includes at least one tension arc segment; and rotating a first cam mechanism associated with the at least one tension arc segment to move the at least one tension arc segment to adjust the position of the tension arc segment relative to the outer circumference of the first end of the roll, so that as the roll and wire sleeve rotate about the first axis, the wire sleeve is concentric with the roll.

20. A method for matching tensioning ring diameter with a through-air roll diameter in a through-air dryer or bonding system, the method comprising:

a. providing a through-air roll with tensioning ring attachment lugs arrayed circumferentially about each end cap of the through-air roll, the tensioning attachment lugs being fitted with a rotating cam mechanism;

b. providing a plurality of tensioning ring segments each having a wire support surface and an assembly flange, which segments, when assembled, form a continuous tensioning ring with the assembly flange in direct or indirect contact with the cam mechanism on each tensioning ring attachment lug, whereby the radius of the continuous tensioning ring can be locally adjusted through rotation of one or more cam mechanism; and c. rotating one or more of the cam mechanism to adjust the tensioning ring segments so that the tensioning ring is concentric with the through-air roll.

* * * * *